US011555464B2

(12) United States Patent
Schöfbänker et al.

(10) Patent No.: US 11,555,464 B2
(45) Date of Patent: Jan. 17, 2023

(54) INJECTOR, AND DEVICE FOR DETECTING THE CONDITION OF SUCH AN INJECTOR

(71) Applicant: LIEBHERR-COMPONENTS DEGGENDORF GMBH, Deggendorf (DE)

(72) Inventors: Norbert Schöfbänker, Ohlsdorf (AT); Richard Pirkl, Regensburg (DE); Lorand D'Ouvenou, Regensburg (DE)

(73) Assignee: LIEBHERR-COMPONENTS DEGGENDORF GMBH, Deggendorf (DE)

( * ) Notice: Subject to any disclaimer, the term of this patent is extended or adjusted under 35 U.S.C. 154(b) by 0 days.

(21) Appl. No.: 16/963,655

(22) PCT Filed: Jan. 22, 2019

(86) PCT No.: PCT/EP2019/051464
§ 371 (c)(1),
(2) Date: Jan. 5, 2021

(87) PCT Pub. No.: WO2019/141865
PCT Pub. Date: Jul. 25, 2019

(65) Prior Publication Data

US 2021/0156326 A1 May 27, 2021

(30) Foreign Application Priority Data

Jan. 22, 2018 (DE) ..... 20 2018 100 337.2

(51) Int. Cl.
*F02D 41/20* (2006.01)
*F02M 65/00* (2006.01)
*F02D 41/24* (2006.01)

(52) U.S. Cl.
CPC ..... *F02D 41/2096* (2013.01); *F02M 65/005* (2013.01); *F02D 41/2467* (2013.01);
(Continued)

(58) Field of Classification Search
CPC ..... F02M 65/00; F02M 65/005; F02D 41/20; F02D 41/2096; F02D 41/24; F02D 41/2467; F02D 2200/063; F02D 2200/247
See application file for complete search history.

(56) References Cited

U.S. PATENT DOCUMENTS 3,021,559 A * 2/1962 Strong ..... B29C 49/60 264/524
3,168,967 A * 2/1965 Giampa ..... B67D 1/0084 222/129.1
4,957,085 A * 9/1990 Sverdlin ..... F02M 47/043 123/41.31
(Continued)

FOREIGN PATENT DOCUMENTS

DE 3445721 A1 7/1985
DE 10313623 A1 10/2004
(Continued)

*Primary Examiner* — John Kwon
*Assistant Examiner* — Johnny H Hoang
(74) *Attorney, Agent, or Firm* — Dilworth & Barrese, LLP

(57) ABSTRACT

The present invention relates to an injector for injecting fuel, comprising an injector housing, a movable nozzle needle which is arranged in the injector housing and has a nozzle needle tip, a nozzle needle seat for receiving the nozzle needle tip, and a mechanical switch which upon contact of the nozzle needle tip with the nozzle needle seat assumes a closed state and upon interruption of the contact assumes an open state, wherein the injector is provided with an input line and an output line for actuating a movement of the nozzle needle, and the switch includes a first terminal and a second terminal. The injector is characterized in that the first terminal of the switch is connected to the input line and the second terminal of the switch is connected to the injector housing.

20 Claims, 3 Drawing Sheets

(52) U.S. Cl.
CPC ..... *F02D 2041/2055* (2013.01); *F02D 2041/2058* (2013.01); *F02D 2200/063* (2013.01); *F02M 2200/247* (2013.01)

(56) References Cited

U.S. PATENT DOCUMENTS

| | | | | |
|---|---|---|---|---|
| 5,890,459 | A * | 4/1999 | Hedrick | F02M 43/00 123/27 GE |
| 6,120,005 | A * | 9/2000 | Wright | F02D 41/20 251/129.09 |
| 6,754,604 | B2 * | 6/2004 | Weiland | F02M 65/00 702/114 |
| 2007/0152659 | A1 * | 7/2007 | Gurich | F02M 59/44 324/207.24 |
| 2014/0326218 | A1 * | 11/2014 | Ru e | F02D 41/3005 123/478 |
| 2016/0177855 | A1 * | 6/2016 | Kusakabe | F02D 41/20 123/490 |
| 2016/0252034 | A1 * | 9/2016 | Li | F02D 41/2096 239/4 |
| 2017/0268473 | A1 | 9/2017 | Legrand | |
| 2018/0112614 | A1 * | 4/2018 | Makino | F02D 41/20 |
| 2018/0320643 | A1 * | 11/2018 | Finch | F02M 35/0204 |
| 2019/0076602 | A1 * | 3/2019 | Dyer | A61M 5/16877 |
| 2020/0063694 | A1 * | 2/2020 | Zimmermann | F02D 41/3005 |
| 2020/0191088 | A1 * | 6/2020 | Steininger | F02D 41/247 |

FOREIGN PATENT DOCUMENTS

| | | | |
|---|---|---|---|
| DE | 10319329 | A1 | 11/2004 |
| DE | 102004001358 | A1 | 8/2005 |
| DE | 102005018589 | A1 | 11/2006 |
| DE | 102012215777 | A1 | 3/2014 |
| WO | 2016/012242 | A1 | 1/2016 |

* cited by examiner

INJECTOR, AND DEVICE FOR DETECTING THE CONDITION OF SUCH AN INJECTOR

BACKGROUND OF THE INVENTION

The present invention relates to an injector and a device for detecting a state of such an injector. Injectors, also called injection valves, are typically used in internal combustion engines. In general, the injectors operate according to a servo principle in which an actuator is put into movement by applying a voltage and a nozzle needle of the injector is lifted from a nozzle needle seat by a hydraulic transmission system or a transmission system based on the piezo principle, whereby a fuel under high pressure is injected into a combustion space. The fundamental operating principle of an injector is known to the skilled person and will only partly be explained in the present invention.

In principle, an injector is of relatively simple construction and has two terminals for control purposes. In general, there are no further terminals which provide signals with information on the actual function of the injector.

In the past, it has been the case that even a delayed reaction of the injector to electrical signals was sufficient to be able to precisely represent the accuracy with respect to the required raw emissions on the motor. However, in connection with increasingly strict emission regulations an even more accurate consideration of the injection behavior of the injector is required, which possibly should also be correctable over the entire service life of an injector or a motor. Despite a precise manufacture, injectors do not show the same behavior and are subject to different fluctuations over their service life. This is caused, for example, by coking effects, a wear of the nozzle seat at the injection nozzle, application-dependent return flow backpressure variations, varying temperatures and further parameters not listed here.

All of these influencing variables cannot be measured and be stored in the controller as a table during the manufacture of an injector. Accordingly, it has been desirable for some time to obtain a feedback from an injector in order to generate conclusions as to its switching behavior. By means of such signals it is possible to realize systems which are provided with a closed control loop and thus can correct deviations from the ideal case. It hence is achieved that the emissions and also the performance parameters can be kept constant within a specified range over the service life of an internal combustion engine despite a change in the injection nozzle, but also despite natural influences which lead to the fluctuation of the precision. This is particularly advantageous in particular with regard to the increasingly challenging emission regulations.

From the prior art, injectors are known which have a control loop and are provided with an additional pressure or vibration sensor. Here, it is disadvantageous that the number of terminals at the injector therefor is increased to at least three contacts (previously, there were two contacts).

An example for an injector from the prior art is shown in FIG. 1.

SUMMARY OF THE INVENTION

The injector for injecting fuel according to the invention comprises an injector housing, a movable nozzle needle which is arranged in the injector housing and has a nozzle needle tip, and a nozzle needle seat for receiving the nozzle needle tip, wherein a contact pairing of nozzle needle and nozzle needle tip generates a mechanical switch which upon contact of the nozzle needle tip with the nozzle needle seat assumes a closed state and upon interruption of the contact assumes an open state, wherein the injector is provided with an input line and an output line for actuating a movement of the nozzle needle, and the switch includes a first terminal and a second terminal. The injector is characterized in that the first terminal of the switch is connected to the input line and the second terminal of the switch is connected to the injector housing.

The mechanical switch accordingly results from the nozzle needle seat and the nozzle needle, which—depending on the state of the injector—touch each other or do not touch each other. The switch can be realized by the contact pairing of needle tip and needle seat.

In dependence on the injection state of the injector, the injector described above includes a switchable switch which with one of its terminals is directly connected to the injector housing. In addition, the other terminal of the switch is connected to the input line for actuating a movement of the nozzle needle so that not more than two lines (input line and output line) must be arranged in a plug of the injector. It thereby is possible to provide a downward compatibility of the injectors of the invention, in which the advantages inherent to the injector of the invention need not necessarily be made use of.

In addition, with an injector of this type it is possible to exactly determine the beginning and the end of the movable nozzle needle being lifted from the associated nozzle needle seat, so that the time of the injection of fuel into a combustion space can be determined exactly. What is accomplished particularly exactly is the detection of the beginning of the injection operation in the so-called ballistic mode of the injector in which the actuation pulses for the injector are so short that the resulting opening of the injector takes place only when the associated actuation pulse has already abated.

The detection of the beginning and end of the lifting of the movable needle nozzle is possible, as the evaluation of a voltage level at the input line varies depending on the state of the switch. It is furthermore advantageous that despite this evaluation possibility a two-pole plug is sufficient for the functionality of the injector. The current flowing over the switch is dissipated via the injector housing, which typically is in contact with a motor block, as the motor block is connected to the system ground. It is clear to the skilled person that not only a variation of the voltage allows conclusions to be made on the state of the switch, but a variation of a differential current from the input line and the output line also allows to draw a corresponding conclusion.

According to an optional modification of the present invention a resistor is connected between the first terminal of the switch and the input line and/or between the second terminal and the injector housing. In a closed state of the switch, this typically high-impedance resistor leads to the fact that a small amount of current flows towards ground via the injector housing. In addition, this resistor serves for the purpose that a certain voltage drops at the same when the switch is in a closed state. It is also possible to also achieve such a resistor by appropriately coating the injector housing at least at the contact points which get in contact with the motor block, so that it is not absolutely necessary to insert a resistor into the lines mentioned above. Furthermore, it is also possible that this connection is realized "inherently" by the nozzle steel. By the screw connection of the injector in the cylinder head, a ground connection between nozzle steel and motor block up to the ground connection at the controller or battery can be obtained. Thus, the circuit can be closed.

It can also be provided that the input line and the output line are connected to an electromagnet or a piezo element, wherein preferably the electromagnet or the piezo element causes the nozzle needle tip to be lifted from the nozzle needle seat upon application of a current guided over the input line and the output line. By such lifting, fuel under high pressure flows into a combustion space when an injector is in operation.

According to an advantageous modification of the present invention, a plug of the injector is of the two-pole type and includes the input line and the output line. Preferably, now further lines are present in the plug for a state detection.

It is ensured thereby that the claimed injector is compatible with old plug contacts and also can cooperate with a particularly simple plug construction. A use also is possible when the detection function inherent to the plug of the invention is not utilized or not needed. The integrated switch and the optional resistor do not impair the function of the injector due to the only very low currents of a few milliamperes. Accordingly, there is not needed a special plug with three or even four connection pins and the tools used so far can be employed in the manufacture.

Furthermore, it can be provided that the injector housing is made of an electrically conducting material.

The present invention also relates to a device for detecting the state of an injector which is configured according to one of the variations described above. This device is designed to apply a diagnostic voltage and/or a diagnostic current to the input line leading into the injector housing, and to detect a voltage profile at the input line and/or to detect a differential current between the input line and the output line.

As already explained above, the mechanical switch of the injector changes its state, depending on whether or not the nozzle needle tip contacts its associated nozzle needle seat. When there is no contact between the nozzle needle tip and the nozzle needle seat, fuel flows out of the injector. In the case of a contact of the nozzle needle tip with its nozzle needle seat, all outlet openings for fuel are closed so that no fuel will flow out from the injector. By detecting a voltage profile at the input line or by detecting a differential current between the input line and the output line, the switch state in the injector can be detected in a simple way. This allows to draw conclusions as to the exact time of opening and closing of the fuel outlet opening of the injector.

According to an optional development of the present invention, an application of the diagnostic voltage is effected via a voltage source or a current source. Preferably, this is effected via the connection of a resistor between the input line and a voltage, in particular a supply voltage. Typically, a movement of the nozzle needle is caused by charging the electromagnet or the piezo element with the supply voltage. Via a resistor or a current source, however, a diagnostic voltage or a diagnostic current can be supplied to the input line of the injector regardless of the actuation state of the injector. Regardless of the actuation state of the injector, the diagnostic voltage or the diagnostic current can be used to detect the state of the mechanical switch in the injector. Hence, one need not rely on the direct application of the supply voltage.

According to the invention, it can furthermore be provided that the diagnostic current or the current resulting from the application of the diagnostic voltage is very small as compared to the current which is required to actuate a movement of the nozzle needle, namely less than or equal to one tenth, preferably less than or equal to one hundredth, and preferably less than or equal to one thousandth of the current for actuation.

It is advantageous when the claimed device furthermore includes a means for voltage detection in order to detect the diagnostic voltage on the input line of the injector.

Furthermore, it can be advantageous when the claimed device furthermore comprises a means for differential current determination in order to determine a differential current flowing between the input line and the output line.

According to another development of the invention, the device is designed to detect a beginning and/or an end of an interruption of a contact of the nozzle needle with its nozzle needle seat with reference to the detected voltage profile and/or the detected differential current. Thus, the beginning and the end of an injection time which is defined by the nozzle needle tip being lifted from its nozzle needle seat and the return into the seat can be determined very exactly.

Furthermore, it can be provided that the injector housing is connected to the ground potential. This is typically accomplished via a motor block with which an injector cooperates during its proper use.

The invention furthermore comprises an internal combustion engine with an injector according to any of the variants discussed above and a device corresponding to the variants discussed above.

Furthermore, the invention comprises a motor vehicle which includes the internal combustion engine defined above.

BRIEF DESCRIPTION OF THE DRAWINGS

Further advantages, details and features of the present invention will become apparent from the following description of Figures, in which.

DESCRIPTION OF THE PREFERRED EMBODIMENTS

Figure 1:
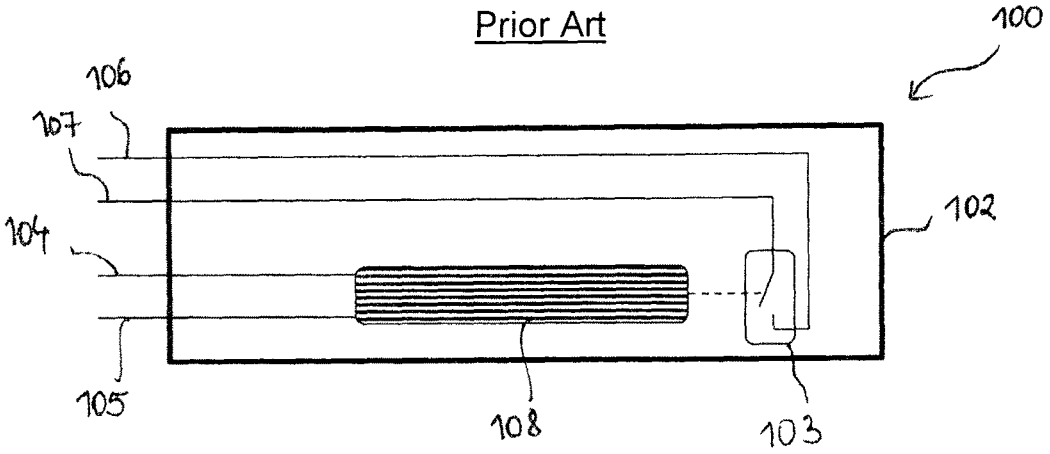
Fig. 1 Prior Art
FIG. 1: shows an injector with a switch from the prior art.

FIG. 1 shows a schematic diagram of an injector as it is known from the prior art. The injector 100 has a housing 102 in which there is a means 108 for moving a nozzle needle out of its associated nozzle needle seat. In addition, there is arranged a mechanical switch 103 which on contact of the nozzle needle with the nozzle needle seat assumes a closed state and upon interruption of this contact assumes an open state. For actuation, an input line 104 and an output line 105, which are connected to the means 108 for moving the nozzle needle, lead into the injector housing 102. In addition, the two contacts 106, 107 of the switch 103 also are lead out from the injector housing 102. In general, this results in an injector which is provided with more than two lines protruding out of the injector housing 102 so that a new plug is to be provided for such an injector 102.

Previously used, conventional injectors 100 use a two-pole plug which merely is necessary for the power supply of the actuator 108. For detecting the position of the switch (also: needle stroke switch) at least one further plug contact 106, 107 is necessary, which requires a novel mechanical design and no longer leaves the injector plug compatible with previous systems.

Figure 2:
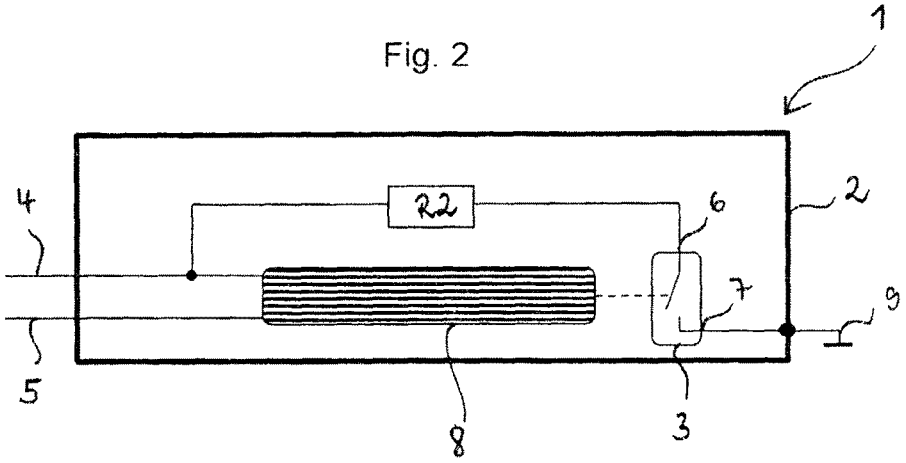
FIG. 2: shows an injector according to the invention.

FIG. 2 shows an embodiment of the injector 1 according to the invention, which is provided with an injector housing 2, an input line 4 leading into the injector housing 2, and an output line 5 leading out of the injector housing 2. In addition, there is provided an actuator 8 for actuating a nozzle needle, which for example can be an electromagnet or a piezo element. Furthermore, a mechanical switch 3 also is disposed in the injector 1, which operates in conjunction with the movement of the nozzle needle of the injector 1. When the nozzle needle is lifted from its seat and the nozzle is cleared for injection, the integrated switch 3 opens its contact. On closing of the needle, by contrast, the contact likewise is closed. A first terminal 6 of the switch 3 is connected to the input line 4 via a resistor R2. The second terminal 7 of the switch 3 is electrically connected to the injector housing 2, which in operation typically is to be equated with ground potential 9.

The information whether the needle stroke switch 3 is closed or open, and thus, whether or not the injection is made, is indicated by an additional power consumption in the injector. In contrast to the prior art configuration, no contact of the switch is directly accessible in the present application. Furthermore, the resistor R2 serves to limit the current to a minimum required measure by means of the contact.

Upon activation of the injector a voltage is applied to the input line 4 and the input line 5, which leads to the fact that the nozzle needle is indirectly put into movement via the actuator 8, which can be designed as an electromagnet or as a piezo element. The needle is lifted from its seat and thus opens the contact. As a result, fuel is injected into the combustion space.

When using such an injector, the differential current method (=fault current detection) is employed for detection purposes. In the process, the current flowing into the injector is compared with the current flowing out. When the switch 3 is closed, slightly more current flows into the injector 1 at one of the terminals as compared to current flowing out via the second terminal. This is due to the fact that a part of the current flows directly to ground 9 via the switch 3. In this way, it can be detected quite well whether or not the switch is closed.

On the other hand, when the current flowing into the injector is identical with the current flowing out from the injector, the switch 3 is open. When both currents are different, a closed switch 3 can be inferred therefrom. This kind of detection, however, only works when a voltage is applied to the injector 1, as a current flow is required for the detection.

Figure 3:
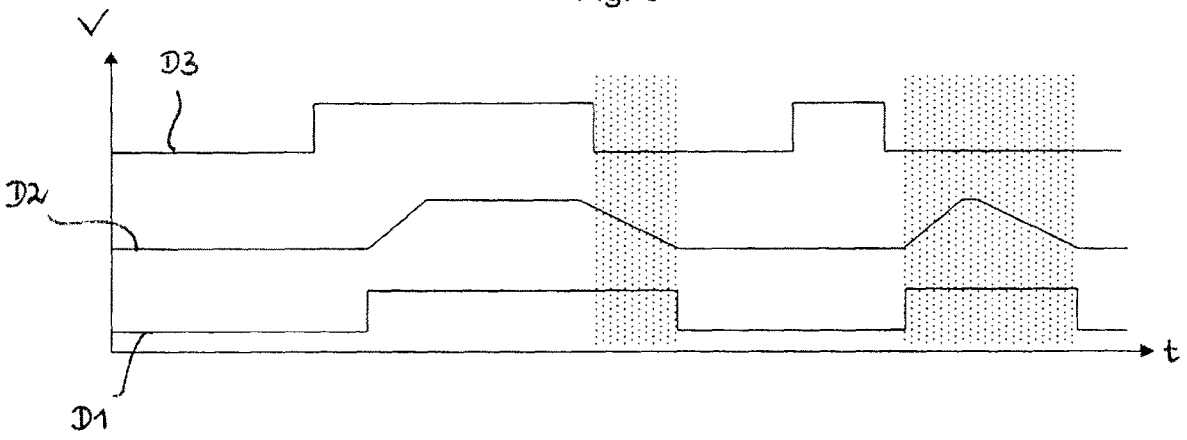
FIG. 3: shows a diagram for the temporal representation of injector voltage, needle movement and needle stroke switch.

FIG. 3 shows the temporal relationship between an application of an injector voltage (diagram D3), a needle movement (diagram D2), and the state of the switch (diagram D1). On activation of the injector, a voltage is applied to the same. This leads to the fact that the nozzle needle starts to move, indirectly driven by an electromagnet or a piezo element. The needle is lifted from its seat and thus opens the contact. As a result, fuel is injected into the combustion space. When the voltage at the injector is removed again, the movements are made in the reverse direction. The needle returns to its seat, the fuel flow is interrupted and the contact is closed again. Due to the inertia of the system to be recognized in FIG. 3, it is a logical consequence that the switching times of the switch 3 (cf. diagram D1) do not coincide exactly with the time points of the application and the removal of the voltage of the injector (cf. diagram D3). Rather, the same are delayed significantly. This can lead to situations in which the injector is no longer energized at all and the needle still has not returned to its seat. In such a case, a started injection still takes place. Only after a delay, the needle and thus the switch 3 as well will be closed. These cases are highlighted in FIG. 3 with dotted areas. As the injector 1 shown in FIG. 2 no longer is energized at these time points, it is not easily possible to detect a possibly present additional current by the needle stroke switch 3.

Previous approaches use the switch in the injector in such a way that the switch contacts are lead out at separate terminals. Then, the same require a four-pole or also three-pole plug. The detection of the switching operation then turns out to be quite simple, in that the switch is detected via a resistance measurement. A low resistance indicates a closed switch, whereas a high resistance represents an open switch.

Figure 4:
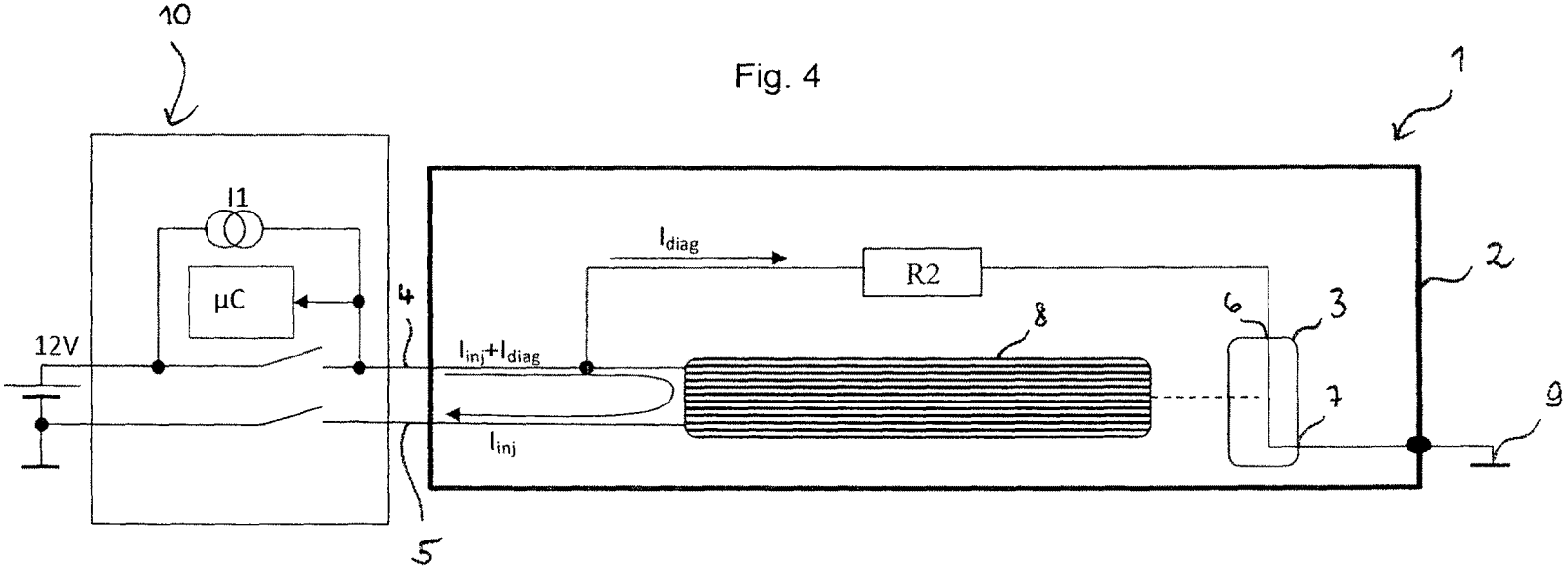
FIG. 4: shows a first embodiment of a device for detecting a state of the injector.

In terms of circuitry, a switch can be detected more easily by connecting one pole of the switch to a common ground and the other pole to the supply voltage via a resistor. When the switch is open, a high voltage is obtained at the pole connected to the resistor, which in the ideal case corresponds to the supply voltage, and when the switch is closed, a low voltage is obtained, which in the ideal case amounts to about zero Volt. It makes no difference whether the switching contact is lead out from the injector via four contacts or three contacts. FIG. 4 shows an interaction of the device 10 of the invention with the injector 1.

The opening and closing of the nozzle needle is detected via the voltage potential at the actuator 8 (solenoid valve coil or the like) after the energization or during an ongoing energization. To detect the change in potential also after energizing the injector, an auxiliary voltage is applied to the injector. It is required to connect this voltage to the pin of the injector 1 to which the internal resistor R2 also is connected. In the present case, this is the input line 4. The desired function can only be achieved in this way.

Figure 5:
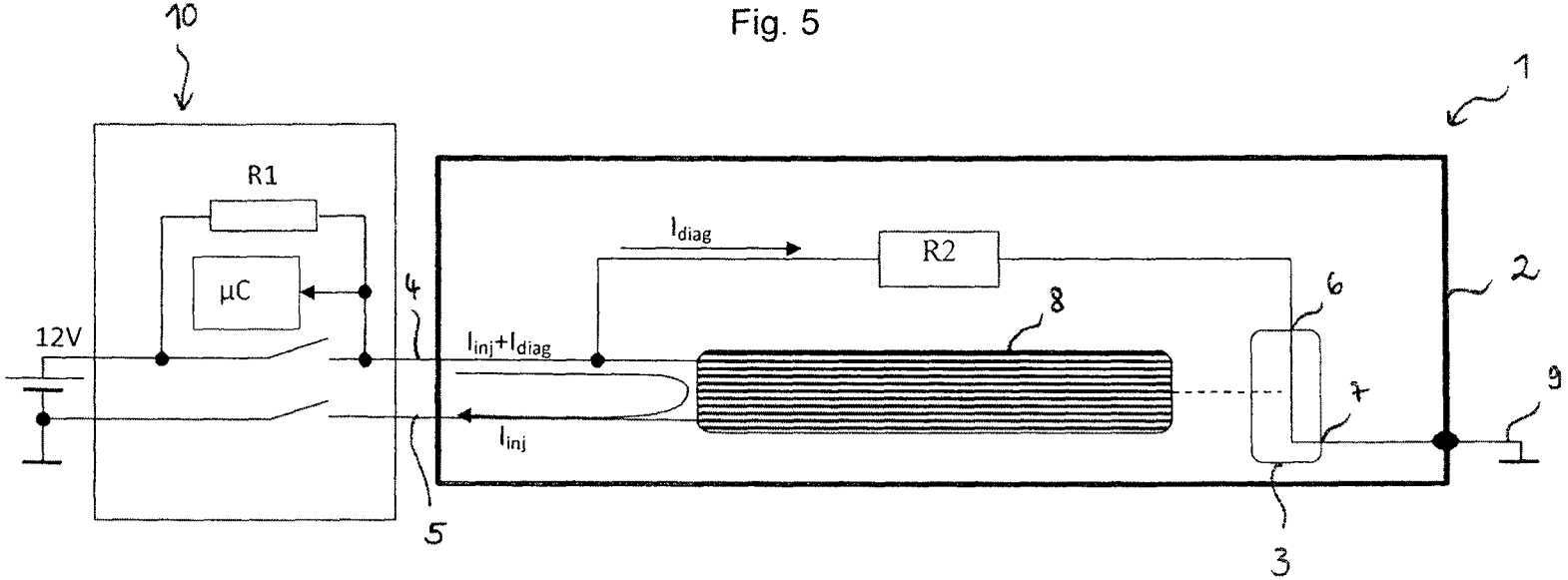
FIG. 5: shows a second embodiment of the device for detecting a state of the injector.

This voltage can be generated either from an active current source I1 or simply by a resistor R1 (cf. FIG. 5). It is decisive that the current $I_{diag}$ is very low as compared to the actual current for the injector drive, so as not to impair the function of the injector 1.

As shown in FIG. 5, the injector has only two terminals 4, 5, one of which (namely the input line 4) is connected to the needle stroke switch 3 via a resistor R2. The second terminal 7 of the switch 3 in turn is connected to the ground-leading housing 2 of the injector 1.

For detecting the switch function, a specifically modified controller is required. As already described above, the function of the switch 3 advantageously can be detected by means of an additional voltage which is realized by a resistor R1 in the controller 10.

While the injector 1 is actuated, a detection of the switch state is not possible. The drive current $I_{inj}$ is higher than the measurement current through the switch 3 by some orders of magnitude, whereby a detection becomes impossible. Upon actuation of the switch 3, the voltage at the input line 4 of the injector 1 changes by less than one thousandth. Detecting this change in a simple way and securely distinguishing the same from a malfunction is not possible without excessive expenditure.

On the other hand, when the injector 1 is "switched off", i.e. the injection is terminated, the needle does not immediately fall back into its seat, but only does so with some delay, as can be taken from FIG. 3 (cf. diagram D2). The needle stroke switch 3 initially remains open, and the resistor R2 thus does not exert any influence on the circuitry in the controller 10. In this time window, the full diagnostic voltage can be measured at the input line 4 of the injector 1 via the resistor R1.

At the end of the delay, the needle falls back into its seat and closes the switch. The resistor R1 in the controller 10 now forms a voltage divider together with the resistor R2 in the injector 1. The voltage at the part of the input line 4 of the injector 1 which is lead out from the injector housing 2 is divided in the ratio (R2/R1+R2) and hence is lower than the applied voltage at R1.

This voltage jump from a higher to a lower voltage can be detected by a microcontroller μC in the controller 10 and can be obtained as information for signaling the end of an injection.

In the case of long injection durations, the beginning of an injection cannot be detected via this auxiliary voltage, but this plays a subordinate role, as the same can be detected at short injection durations and thus can also be transferred to longer injection durations. What is more decisive is the closing time of the injection valve, as this time has a very much larger temporal variance. In other words, this point in time spreads more. To each measure this closing time is made possible by the present invention in conjunction with the especially configured injector, which has merely two connection poles. As is shown in FIG. 3 with reference to the second injection, the detection of the beginning and end of the injection is possible with very short actuation times, i.e. in the so-called ballistic mode. In such a case, the movement of the needle takes place with such a delay that the current flow in the injector 1 already has abated and the detection of the switch state is possible undisturbed.

The particular advantage of this invention is an injector 1 remaining compatible. It still requires only two connection pins and can also be used in applications in which the detection function is not utilized or needed. The integrated switch 3 and the resistor R2 do not impair the function of the injector 1 due to the minimum currents of a few milliamperes.

Consequently, there is not needed a special plug with three or four connection pins, and tools used so far can be employed in the manufacture.

On the other hand, the evaluation of the signal on the part of the controller is very simple. To generate the diagnostic signal, only a single resistor R1 is needed, which generates the required diagnostic voltage. An additional line is not required either in order to apply this voltage to the injector 1. For detecting the voltage jump, no complex circuitry is necessary in the controller 10, as in the simplest case and with an appropriate design a digital input of a controller μC or a threshold switch is sufficient, which reacts to the two different voltage states. Circuit modules which are influenced in the decisive properties by temperature drift and tolerances and thus have a low signal-to-noise ratio are not required. Pure voltage levels with a large voltage difference can be detected very easily and very securely even with high temperature fluctuations and component tolerances.

The invention allows the detection of the injection only after the energization of the injector 1 has been terminated, which, as described above, is not too great a disadvantage, as the end of an injection is much more relevant and the injection start learned at small injection quantities can be transferred to longer injections. When the opening time nevertheless is to be detected also during the energization of the injector, the method can be combined with the differential current method.

Figure 6:
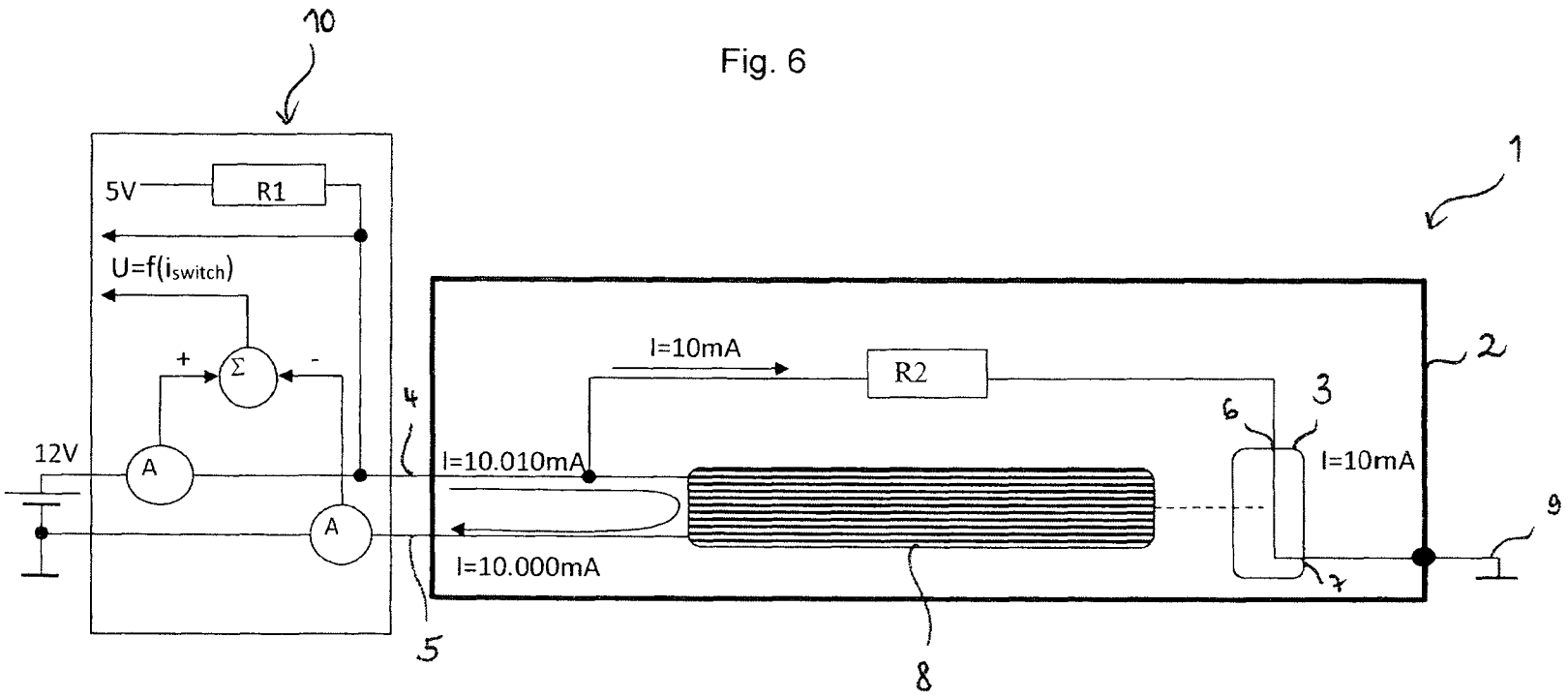
FIG. 6: shows a third embodiment for detecting a state of the injector.

For the differential current method, as shown in FIG. 6, a further resistor is added in the controller so that even in the non-actuated state of the injector an auxiliary voltage is applied to the injector.

The invention claimed is:

1. An injector (1) for injecting fuel, comprising:

an injector housing (2), a movable nozzle needle which is arranged in the injector housing (2) and has a nozzle needle tip, and a nozzle needle seat for receiving the nozzle needle tip and arranged within the injector housing (2), wherein a switch (3) is defined within the injector housing (2) by contact pairing of the nozzle needle and the nozzle needle seat, on contact of the nozzle needle tip with the nozzle needle seat, said switch (3) assumes a closed state and upon interruption of the contact, said switch (3) assumes an open state, the injector (1) is provided with an input line (4) and an output line (5) extending into the injector housing (2) for actuating movement of the nozzle needle, the switch (3) formed by said nozzle needle and seat includes a first terminal (6) and a second terminal (7), the first terminal (6) of the switch (3) is electrically connected to the input line (4), the second terminal (7) of the switch (3) is electrically connected to the injector housing (2), and a plug on the injector housing (2) has only two poles and only includes the input line (4) and the output line (5), and includes no further lines for detecting opened or closed state of the injector (1), wherein the injector is provided with the input line and the output line for actuating a movement of the nozzle needle, the switch includes a first terminal and a second terminal, and the injector is configured and positioned to apply a diagnostic voltage and a diagnostic current to the input line leading into the injector housing, to detect a voltage profile at the input line and to detect a differential current between the input line and the output line.

2. The injector (1) according to claim 1, wherein the injector housing (2) is made of an electrically conducting material.

3. The combination of an injector (1) for injecting fuel, comprising:

an injector housing (2), a movable nozzle needle which is arranged in the injector housing (2) and has a nozzle needle tip, and a nozzle needle seat for receiving the nozzle needle tip and arranged within the injector housing (2), and a device (10) configured and arranged for detecting the state of the injector (1), wherein a switch (3) is defined within the injector housing (2) by contact pairing of the nozzle needle and the nozzle needle seat, on contact of the nozzle needle tip with the nozzle needle seat, said switch (3) assumes a closed state and upon interruption of the contact, said switch (3) assumes an open state, the injector (1) is provided with an input line (4) and an output line (5) extending into the injector housing (2) for actuating movement of the nozzle needle, the switch (3) formed by said nozzle needle and seat includes a first terminal (6) and a second terminal (7), the first terminal (6) of the switch (3) is electrically connected to the input line (4), the second terminal (7) of the switch (3) is electrically connected to the injector housing (2), a plug on the injector housing (2) has only two poles and only includes the input line (4) and the output line (5), and includes no further lines for detecting opened or closed state of the injector (1), the device (1) is configured and positioned to apply a diagnostic voltage and a diagnostic current ($I_{diag}$) to the input line (4) leading into the injector housing (2), to detect a voltage profile at the input line (4) and to detect a differential current between the input line (4) and the output line (5).

4. The combination according to claim 3, wherein an application of the voltage is effected via at least one of a voltage source and a current source.

5. The combination according to claim 4, wherein the application of the voltage is effected via the connection of a resistor (R1) between the input line (4) and a supply voltage.

6. The combination according to claim 3, wherein at least one of the current ($I_{diag}$) and the current ($I_{diag}$) resulting from the application of the voltage is very small as compared to the current ($I_{inj}$) which is required to actuate a movement of the nozzle needle.

7. The combination according to claim 6, wherein at least one of the current ($I_{diag}$) and the current ($I_{diag}$) resulting from the application of the voltage is less than or equal to one tenth of the current ($I_{inj}$) for actuation.

8. The combination according to claim 7, wherein at least one of the current ($I_{diag}$) and the current ($I_{diag}$) resulting from the application of the voltage is less than or equal to one hundredth of the current ($I_{inj}$) for actuation.

9. The combination according to claim 6, wherein at least one of the current ($I_{diag}$) and the current ($I_{diag}$) resulting from the application of the voltage is less than or equal to one thousandth of the current ($I_{inj}$) for actuation.

10. The combination according to claim 3, further comprising a means (μC) for voltage detection to detect the diagnostic voltage at the input line (4) of the injector (1).

11. The combination according to claim 3, further comprising means for differential current determination to detect a differential current flowing between the input line (4) and the output line (5).

12. The combination according to claim 3, wherein the device (10) is configured to detect at least one of a beginning and an end of the nozzle needle being lifted from its nozzle needle seat with reference to the detected voltage profile or the detected differential current.

13. The combination according to claim 3, wherein at least one of the voltage and the current ($I_{diag}$) is applied independently of at least one of an actuation current and an actuation voltage for the injector (1).

14. The injector (1) according to claim 1, wherein the injector housing (2) is connected to ground potential (9).

15. The injector (1) according to claim 1, wherein between the second terminal (7) and the injector housing (2), a resistor (R2) is connected.

16. The injector (1) according to claim 15, wherein between the first terminal (6) of the switch (3) and the input line (4), a resistor (R2) is also connected.

17. An injector (1) for injecting fuel, comprising:

an injector housing (2), a movable nozzle needle which is arranged in the injector housing (2) and has a nozzle needle tip, and a nozzle needle seat for receiving the nozzle needle tip and arranged within the injector housing (2), wherein a switch (3) is defined within the injector housing (2) by contact pairing of the nozzle needle and the nozzle needle seat, on contact of the nozzle needle tip with the nozzle needle seat, said switch (3) assumes a closed state and upon interruption of the contact, said switch (3) assumes an open state, the injector (1) is provided with an input line (4) and an output line (5) extending into the injector housing (2) for actuating movement of the nozzle needle, the switch (3) formed by said nozzle needle and seat includes a first terminal (6) and a second terminal (7), the first terminal (6) of the switch (3) is electrically connected to the input line (4), the second terminal (7) of the switch (3) is electrically connected to the injector housing (2), a plug on the injector housing (2) has only two poles and only includes the input line (4) and the output line (5), and includes no further lines for detecting opened or closed state of the injector (1), and between the first terminal (6) of the switch (3) and the input line (4), a resistor (R2) is connected), wherein the injector is provided with the input line and the output line for actuating a movement of the nozzle needle, the switch includes a first terminal and a second terminal, and the injector is configured and positioned to apply a diagnostic voltage and a diagnostic current to the input line leading into the injector housing, to detect a voltage profile at the input line and to detect a differential current between the input line and the output line.

18. An injector (1) for injecting fuel, comprising:

an injector housing (2), a movable nozzle needle which is arranged in the injector housing (2) and has a nozzle needle tip, and a nozzle needle seat for receiving the nozzle needle tip and arranged within the injector housing (2), wherein a switch (3) is defined within the injector housing (2) by contact pairing of the nozzle needle and the nozzle needle seat, on contact of the nozzle needle tip with the nozzle needle seat, said switch (3) assumes a closed state and upon interruption of the contact, said switch (3) assumes an open state, the injector (1) is provided with an input line (4) and an output line (5) extending into the injector housing (2) for actuating movement of the nozzle needle, the switch (3) formed by said nozzle needle and seat includes a first terminal (6) and a second terminal (7), the first terminal (6) of the switch (3) is electrically connected to the input line (4), the second terminal (7) of the switch (3) is electrically connected to the injector housing (2), a plug on the injector housing (2) has only two poles and only includes the input line (4) and the output line (5), and includes no further lines for detecting opened or closed state of the injector (1), and an actuator (8) is connected to both the input line (4) and the output line (5) and configured to cause the nozzle needle tip to be lifted from the nozzle needle seat upon application of a current guided over the input line (4) and the output line (5)), wherein the injector is provided with the input line and the output line for actuating a movement of the nozzle needle, the switch includes a first terminal and a second terminal, and the injector is configured and positioned to apply a diagnostic voltage and a diagnostic current to the input line leading into the injector housing, to detect a voltage profile at the input line and to detect a differential current between the input line and the output line.

19. The injector (1) according to claim 18, wherein the actuator (8) is an electromagnet.

20. The injector (1) according to claim 18, wherein the actuator (8) is a piezo element.

* * * * *